US005968270A

United States Patent [19]

Damrau

[11] Patent Number: 5,968,270

[45] **Date of Patent: *Oct. 19, 1999**

[54] APPARATUS FOR DECREASING SKIP COATING ON A PAPER WEB

[75] Inventor: Wayne A. Damrau, Wisconsin Rapids, Wis.

[73] Assignee: Consolidated Papers, Inc., Wisconsin Rapids, Wis.

[ * ] Notice: This patent is subject to a terminal disclaimer.

[21] Appl. No.: 09/076,694

[22] Filed: May 12, 1998

Related U.S. Application Data

[60] Continuation of application No. 08/800,407, Feb. 14, 1997, Pat. No. 5,789,023, which is a division of application No. 08/432,431, Apr. 27, 1995, Pat. No. 5,603,767, which is a division of application No. 08/241,475, May 12, 1994, Pat. No. 5,436,030, which is a continuation-in-part of application No. 07/943,919, Sep. 11, 1992, abandoned.

[51] Int. Cl.[6] ..... B05C 5/00

[52] U.S. Cl. ..... 118/410; 118/411; 118/413; 118/419

[58] Field of Search ..... 118/410, 411, 118/413, 419, 324, 52, 123, 118, DIG. 4; 427/240, 356, 420

[56] References Cited

U.S. PATENT DOCUMENTS

| | | | |
|---|---|---|---|
| 3,991,236 | 11/1976 | Fleissner | 427/315 |
| 4,143,190 | 3/1979 | Choinski | 427/420 |
| 4,290,791 | 9/1981 | Matsui et al. | 96/212 |
| 4,299,188 | 11/1981 | Isayama et al. | 118/412 |
| 4,324,820 | 4/1982 | Weldon | 427/420 |
| 4,534,309 | 8/1985 | Damrau et al. | 118/410 |
| 4,643,746 | 2/1987 | Suzuki et al. | 96/209 |
| 4,868,017 | 9/1989 | Hammon et al. | 427/356 |
| 5,105,760 | 4/1992 | Takahashi et al. | 118/410 |
| 5,186,753 | 2/1993 | Nakazawa et al. | 118/410 |
| 5,302,206 | 4/1994 | Shibata et al. | 118/410 |
| 5,376,178 | 12/1994 | Sato | 118/410 |
| 5,380,365 | 1/1995 | Hirshburg | 118/411 |
| 5,436,030 | 7/1995 | Damrau | 427/240 |
| 5,603,767 | 2/1997 | Damrau | 118/410 |

FOREIGN PATENT DOCUMENTS

| | | |
|---|---|---|
| WO95 12031 | 5/1995 | WIPO . |
| WO96 07790 | 3/1996 | WIPO . |

*Primary Examiner*—Laura Edwards
*Attorney, Agent, or Firm*—Juettner Pyle & Piontek

[57] ABSTRACT

A fountain applicator for applying coating liquid onto a web of paper carried past the applicator, has a coating liquid flow path that includes a curved surface along which a sheet of the coating liquid is flowed to subject the sheet to centrifugal force to cause air entrained in the coating liquid to move away from one side of the sheet that is toward the curved surface, so that the one side is relatively free of entrained air. After being flowed along the curved surface, the sheet of coating liquid is directed toward the web in a free standing jet curtain of coating liquid, to contact the web surface primarily with the one relatively air-free side of the coating liquid sheet to decrease the occurrence of skip coating on the web surface, especially when the web is traveling past the applicator at high speeds. The coating is applied in excess onto the web surface and is metered and leveled to a desired coat weight by a downstream doctor. The downstream doctor may comprise a single metering device, or it may comprise an intermediate metering device followed by a final metering and leveling device.

21 Claims, 6 Drawing Sheets

APPARATUS FOR DECREASING SKIP COATING ON A PAPER WEB

This application is a continuation of application Ser. No. 800,407, filed Feb. 14, 1997, now U.S. Pat. No. 5,789,023, which is a division of application Ser. No. 432,431, filed Apr. 27, 1995 and now U.S. Pat. No. 5,603,767, which is a division of application Ser. No. 241,475.

BACKGROUND OF THE INVENTION

The present invention relates to a method of and apparatus for applying liquid coating material onto a moving web of paper, and in particular to a coating method and apparatus of the fountain applicator type.

Coating a web of paper is generally effected by the application of a liquid coating material onto a moving web. The coating material may be comprised of a solid constituent suspended in a liquid carrier. The quality of the coating applied onto the paper web depends upon a number of factors, an important one of which being how the material is applied. The application of the coating material should preferably result in a coating that is continuous and uniform across the web.

One method previously used to coat paper webs was to feed liquid coating material to applicator rolls that applied the material directly onto the moving web. While the use of applicator rolls yields a fairly uniform coating across the web, as web speeds increase, there often occurs a film split pattern in the coating applied onto the web, i.e., cross-direction variations in the weight of the coating on the web. This technique therefore does not lend itself to coating webs at high speeds. Direct application by rolls also creates forces in the roll/web nip that imbed or force coating material into the web instead of covering the outer surface of the web to enhance smoothness.

In an attempt to avoid these and other problems, the art developed a coating process in which the liquid coating material was jetted in a free standing curtain of coating liquid directly onto the moving web with a fountain applicator. While fountain applicators overcome many of the limitations of roll applicators, in their use, skip coating often occurs. Skip coating is caused by air entrained in the coating liquid being contacted against the paper web and preventing the coating liquid from uniformly contacting and being uniformly applied onto the web surface. To decrease the severity of the skip coating problem, fountain applicators customarily include coating/air separation equipment to remove air from coating liquid prior to delivery of the coating liquid to the applicator, but the equipment is not 100% effective and some air remains entrained in the coating liquid jetted against the web surface and causes skip coating.

OBJECTS OF THE INVENTION

An object of the present invention is to provide an improved fountain applicator for applying liquid coating material onto a paper web, in which the resulting coating on the web is substantially skip free.

Another object is to provide such a fountain applicator, in which a sheet of coating liquid is flowed along a curved surface substantially immediately prior to being impinged against the web, to subject the sheet to centrifugal force to cause air entrained in the coating liquid to move away from the curved surface.

A further object is to provide such a fountain applicator, in which the sheet of coating liquid, after leaving the curved surface, is directed toward the web in a free standing jet curtain of coating liquid that is impinged against the web, to contact the web surface primarily with the side of the jet curtain of coating liquid that was toward the curved surface and is relatively free of entrained air, to decrease the occurrence of skip coating on the web surface.

Yet another object is to provide such a fountain applicator in a paper coating system that includes a downstream doctor for metering and leveling on the web surface an excess coating layer applied onto the web surface by the applicator.

SUMMARY OF THE INVENTION

In accordance with the present invention, an applicator for applying coating liquid onto a surface of a moving web comprises an elongate concave curved surface that is positionable proximate to, transversely of and spaced from the web; and means for forming an elongate sheet of coating liquid, for flowing the sheet along the curved surface, and for then projecting the sheet in a free standing jet curtain of coating liquid against and across the surface of the web. The coating liquid sheet, upon being flowed along the curved surface, is subjected to centrifugal force to cause air entrained in the coating liquid sheet to move away from one side of the sheet that is toward the curved surface, so that the one side is then relatively free of entrained air. The free standing jet curtain of coating liquid is directed against the web to contact the web surface primarily with the one relatively air-free side of the coating liquid sheet to decrease the occurrence of skip coating on the web surface.

The applicator applies the coating in excess onto the web surface, and also included are downstream doctor means for metering and leveling the excess coating layer to a desired coat weight. The doctor means may comprise a single metering device. Alternatively, the doctor means may comprise a first metering device for partially metering and leveling the coating layer, followed by a second and final metering device for metering and leveling the coating to the desired final coat weight.

The invention also contemplates a method of applying a coating liquid onto a surface of a moving web, which comprises the step of flowing a sheet of coating liquid along an elongate concave curved surface that is proximate to, extends transversely of and is spaced from the web, to subject the coating liquid sheet to centrifugal force to cause air entrained in the coating liquid to move away from one side of the sheet that is toward the curved surface, so that the one side of the sheet is relatively free of entrained air. Also, included is the step of directing the sheet of coating liquid, after it has been flowed along the curved surface, toward the web in a free standing jet curtain of coating liquid, to contact the web surface primarily with the one relatively air-free side of the coating liquid sheet to decrease the occurrence of skip coating on the web surface.

The coating liquid is applied is excess onto the web surface, and the method also includes the step of doctoring the excess coating layer on the web to a final coat weight. The doctoring step may comprise doctoring the excess coating layer with a single metering device. Alternatively, the doctoring step may comprise metering and leveling the coating layer with an initial metering device, followed by metering and leveling the coating layer to a desired final coat weight with a second metering device.

DETAILED DESCRIPTION

The Prior Art

Figure 1:
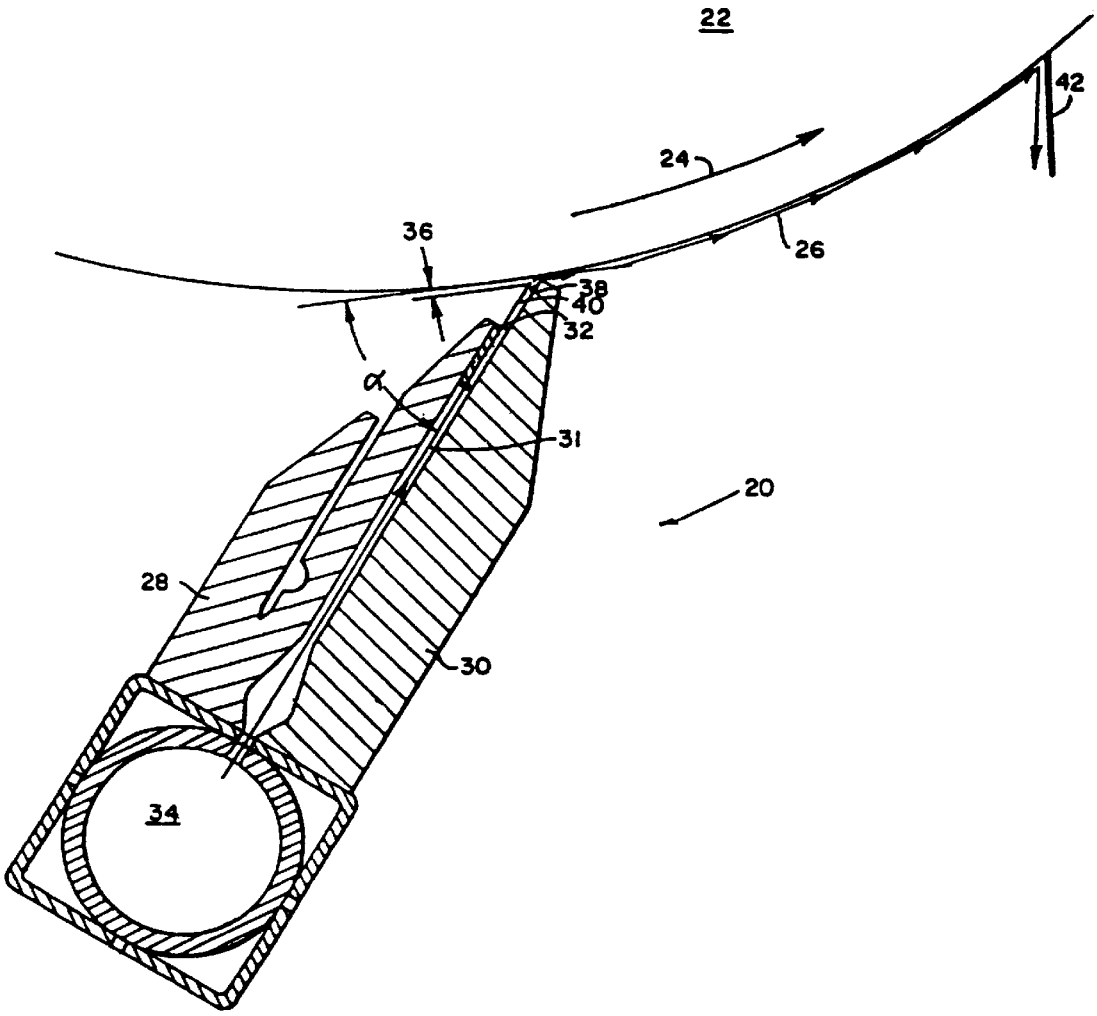
FIG. 1 (PRIOR ART)
FIG. 1 shows a prior art fountain applicator.

A fountain applicator of a type contemplated by the prior art is shown in FIG. 1 and indicated generally at 20. The applicator is part of a paper coating machine, and extends parallel to and coextensively with a movable support or backing roll 22 which rotates in a direction shown by an arrow 24 and supports a web of paper 26 during its travel past the applicator. The applicator has front and rear walls 28 and 30 that form an elongate metering slot 31 leading to an elongate outlet nozzle 32. The metering slot communicates with a chamber 34 that receives liquid coating material under pressure from a source of material, for flow of the coating liquid upwardly to and through the outlet nozzle, as indicated by the line and arrow. The outlet nozzle extends coextensively with the backing roll 22 and transversely of and across the paper web, and is proximate to and faces the paper web where it is supported on the backing roll. The upper end of the applicator rear wall 30 extends beyond the upper end of the applicator front wall 28 and defines a gap 36 with the web, and where it extends beyond the applicator front wall, the applicator rear wall has a flat surface 38. Coating liquid introduced into the chamber 34 flows upwardly to and out of the outlet nozzle in a sheet of coating liquid 40 that flows across the flat surface 38 at the upper end of the applicator rear wall. Upon leaving the flat surface, the sheet of coating liquid is directed in a free standing jet curtain of coating liquid against and transversely across the paper web, at an acute included angle a with the web, as the web is moved past the applicator.

In operation of the applicator 20, the free standing jet curtain of coating liquid is impinged against the surface of the backing roll supported paper web 26 to apply onto the web surface an excess layer of coating liquid that is doctored to a desired coat weight by a downstream doctor 42. In order for the applicator to apply an excess coating layer that is reasonably free of voids or skips, it is imperative that there not be an excessive amount of air entrained in the coating. To minimize entrained air, a conventional air removal system may be incorporated into the coating supply system that delivers coating liquid to the applicator, such air removal systems being well known in the art and two representative examples of such being taught by U.S. Pat. Nos. 4,290,791 and 4,643,746. However, even when an air removal system is employed, some air remains entrained in the coating and contacts the web, causing skip coating on the web, especially at high speeds of travel of the web past the applicator.

The Invention

Figure 2:
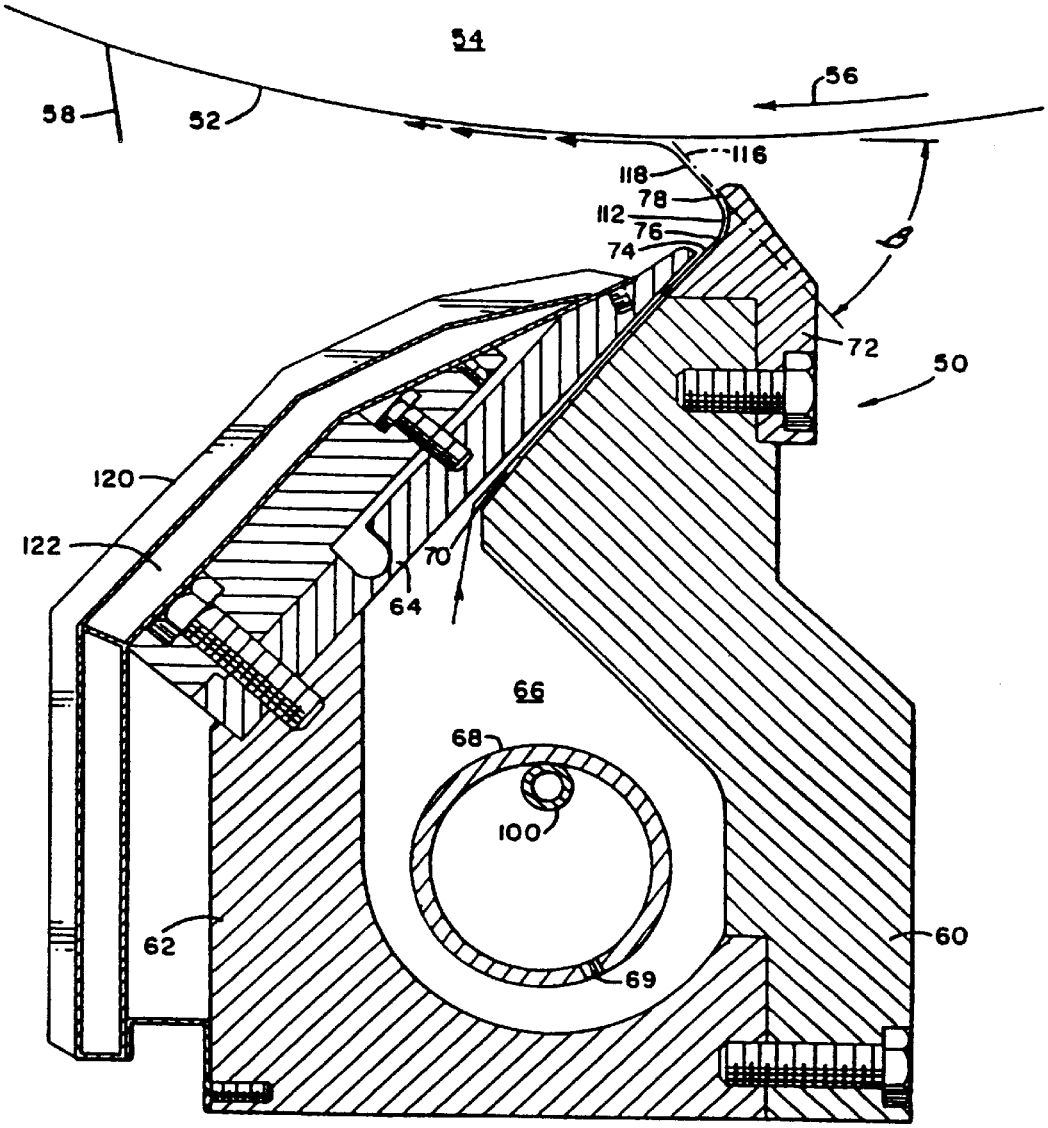
FIG. 2 shows a fountain applicator that embodies the teachings of the present invention.

In improving upon prior fountain applicators, the invention provides improved fountain applicators that are uniquely configured to apply onto a surface of a paper web a coating layer that is essentially skip free. One such applicator is shown in FIG. 2 and is configured to cause air entrained in a coating liquid sheet that is emitted from an elongate fountain outlet nozzle, to move away from a side of the sheet that is impinged against the web, so that the web surface is contacted primarily with coating liquid that is relatively free of entrained air. This is accomplished by flowing the coating liquid sheet along a curved surface of the applicator, to subject the coating liquid sheet to centrifugal force to cause the dense coating liquid to move toward one side of the coating liquid sheet that is toward the curved surface and impinged against the paper web, and air entrained in the coating liquid to move away from the one side and toward an opposite side of the sheet that is away from the curved surface and out of substantial contact with the web. The radius of the curved surface is selected for the magnitude of centrifugal force desired, the magnitude also being a function of the flow velocity of the coating liquid sheet across the curved surface. The flow velocity of the coating liquid sheet is, in turn, a function of the cross sectional area of the fountain outlet nozzle and of the volume flow rate of coating liquid through the nozzle, and must be such as to ensure that the coating liquid applied onto the paper web completely and uniformly covers the web surface.

More particularly, the fountain applicator of FIG. 2 is indicated generally at 50 and applies onto a surface of a paper web 52, which is carried past the applicator on a backing roll 54 that rotates in a direction as shown by an arrow 56, an excess layer of coating liquid that is doctored to a desired coat weight by a downstream doctor means such as a blade 58. The fountain applicator is part of a paper coating machine, and extends in the cross-machine direction, parallel to the backing roll 54 and transversely of, across and spaced from the backing roll supported web. The applicator has front and rear walls 60 and 62, and attached to the upper end of the rear wall is a plate 64. The front and rear walls and the plate form a chamber 66 therewithin, into which liquid coating material is delivered under pressure via a coating liquid distribution pipe 68 that extends longitudinally through the chamber and has a plurality of coating outlet openings 69 spaced longitudinally therealong. The front and rear walls may be hinged at their lower ends for movement apart to provide access to the chamber 66 for cleaning, for example as taught by U.S. Pat. No. 4,534,309.

A metering slot 70 is defined between the front wall 60 and the plate 64. The metering slot extends upwardly from the chamber 66 and transversely of and across the backing roll supported web 52, and from bottom to top is inclined toward the front of the applicator to enhance a migration of air entrained in the coating liquid upwardly toward the side of the metering slot defined by the plate. A replaceable elongate deflector tip 72 is at the upper end of the front wall and an elongate outlet nozzle 74 from the metering slot is at the top of the plate 64 between the plate and the deflector tip. On its side toward the outlet nozzle, the deflector tip has an elongate flat surface 76 and an elongate concave curved surface 78 that is positioned proximate to, transversely of and spaced from the web. The flat surface begins within the metering slot, it may but does not necessarily need to extend upwardly beyond the outlet nozzle, and leads to the curved surface. Coating liquid exiting the elongate outlet nozzle flows in a sheet along the flat surface of the deflector tip to, along and then off of the curved surface in a free standing sheet or jet curtain of coating liquid that is directed against and across the web surface at an appropriate included acute angle. If desired, the downstream end of the coating liquid flow surface of the deflector tip could terminate in an elongate flat surface (not shown) of relatively limited length beyond the curved surface 78, along which the coating liquid sheet would flow after leaving the curved surface and before being projected toward the web in a free standing sheet or jet curtain of coating liquid. Adjustable deckle devices (not shown) may be at opposite ends of the elongate outlet nozzle to control its transverse extent and, therefore, the transverse extent of the sheet of coating liquid, thereby to control the width of the coating layer applied onto the web.

Figure 3:
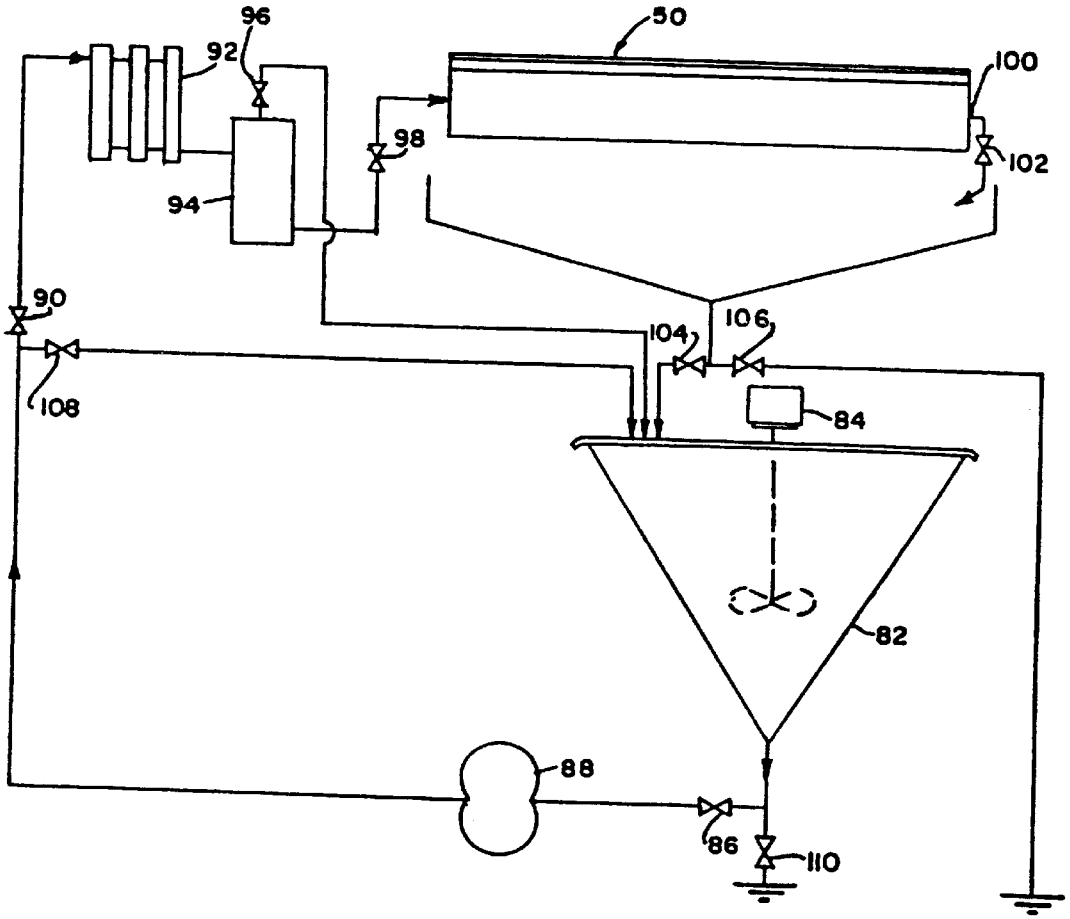
FIG. 3 illustrates a coating supply system of a type that may be used to deliver coating liquid to the fountain applicator of the invention.

Before considering the manner of operation of the fountain applicator 50, a typical coating supply system for the applicator will first be considered in general terms. As seen in FIG. 3, a coating supply system may include a covered surge tank 82 for holding a main supply of liquid coating material that is stirred by a motor driven impeller unit 84. Coating liquid flows from the tank through a valve 86 to a pump 88 that delivers the coating liquid under pressure through a valve 90 and a mesh filter 92 to an air removal device 94 that advantageously is of a type disclosed in copending patent application Ser. No. 08/228,281 to James Hoogesteger and Wayne Damrau, filed Apr. 15, 1994 and assigned to the assignee of the present invention, the teachings of which are specifically incorporated herein by reference. The air removal device may be of a conventional type, and operates to remove entrained air from coating liquid supplied from the surge tank and to deliver the removed air, carried in a small portion of the coating liquid, through a valve 96 for return to the surge tank. The remaining coating liquid exiting the air removal device is flowed through a valve 98 into one end of the distribution pipe 68 of the fountain applicator 50. At an opposite end of the distribution pipe there is an outlet 100 from the top of the distribution pipe (FIG. 2), that leads back to the surge tank through a valve 102. The outlet allows recirculation of a small portion of the coating liquid supplied to the distribution pipe, in order to remove accumulated air from the top of the distribution pipe and enhance a uniform pressure of coating liquid throughout the chamber 66 for uniform application of coating onto the moving web. Valves 104 and 106 selectively direct coating liquid returned from the fountain applicator to the surge tank, to a sewer and/or to reclamation apparatus. A valve 108 is connected between the upstream side of the valve 90 and the surge tank, and a valve 110 at an outlet from the surge tank leads to the sewer or the reclamation apparatus. When the fountain applicator is operating, the valves 86, 90, 96, 98, 102 and 104 are open and the valves 106, 108 and 110 are closed. When the fountain applicator is not operating, the various valves are selectively opened or closed to accomplish a desired result (e.g., to accommodate cleaning of the system with wash water), as is readily understood by those skilled in the art.

In operation of the fountain applicator 50 and with reference to FIG. 2, coating liquid delivered to the applicator by the coating supply system is introduced into one end of the distribution pipe 68 and flows through the pipe openings 69 into the chamber 66. The air removal device 94 removes from the coating liquid much of the entrained air, but it is not 100% effective, so some air remains entrained in the coating liquid delivered to the applicator. Some of the remaining air that accumulates at the top of the distribution pipe passes through the outlet 100 and is removed, but some still remains entrained in the coating, and with prior fountain applicators, this limited amount of remaining entrained air causes skip coating on a paper web. However, in use of the applicator of the invention, entrained air remaining in the coating liquid flowed from the chamber 66 and out of the outlet nozzle 74 is prevented from contacting the surface of the web, and therefore from causing skip coating.

More specifically, coating liquid delivered into the chamber 66 flows upwardly through the metering slot 70 and exits the elongate outlet nozzle 74 in an elongate sheet 112 of coating liquid that extends transversely of the paper web 52. The sheet of coating liquid flows along the deflector tip flat surface 76 to the concave curved surface 78, where the sheet is forcefully flowed against the curved surface as its direction of flow changes to conform to the curved surface. Causing the coating liquid sheet to follow the curved surface subjects it to a centrifugal force that causes the dense coating liquid to move toward one side 116 of the sheet that is toward the curved surface and the much less dense air entrained in the coating liquid to move away from the one side and toward an opposite side 118 of the sheet that is away from the curved surface, so that the one side of the coating liquid sheet is relatively free of entrained air. After flowing along the curved surface, the sheet of coating liquid flows off of the deflector tip in a free standing elongate sheet or jet curtain of coating liquid directed toward, transversely across and against the paper web surface, such that an included acute angle $\beta$ is defined between the plane of the sheet of coating liquid and a tangent to the web at the point of contact of the sheet with the web. In consequence, the web surface is contacted primarily with the one side 116 of the coating liquid sheet that is relatively free of entrained air, while the opposite side 118 of the sheet of coating liquid, toward which the entrained air has moved, is out of substantial contact with the web, so that there is a decrease in the occurrence of skip coating on the web surface. The layer of coating liquid applied onto the web by the applicator is in excess and is doctored to a desired final coat weight by the downstream doctor means 58.

The minimum centrifugal force to which the sheet of coating liquid 112 is to be subjected is that which just results in application of a substantially skip-free coating onto the paper web 52. As is known, the centrifugal force exerted on the sheet of coating liquid is equal to the product of the mass of the coating liquid and its flow velocity squared, divided by the radius of the defector tip curved surface 78. The mass of the coating liquid may be considered as a constant, which in practical terms means that the centrifugal force may be varied by changing either the flow velocity of the coating liquid sheet or the radius of the curved surface. The flow velocity of the coating liquid sheet is a function of the cross sectional area of the elongate outlet nozzle 74 and of the volume flow rate of coating liquid through it, and is chosen so that the applied coating completely and uniformly covers the web surface. Since there are limits on the minimum volume flow rate of coating liquid required to obtain a uniform coating on the paper web, and since there are practical limits on the maximum volume flow rate of coating liquid that can be forced through the metering slot 70 and outlet nozzle 74, to subject the coating liquid stream to a desired centrifugal force, it usually is most convenient to control the radius of the deflector tip curved surface 78. Nevertheless, while the magnitude of centrifugal force exerted on the coating liquid sheet may be increased by decreasing the radius of the deflector tip curved surface and vice versa, there also are practical limits on how small the radius may be. It presently is contemplated that the curved surface have a radius on the order of about 0.125" to 0.500", which is believed to be sufficient to properly densify the coating liquid on the side 116 of the coating liquid sheet that is impinged against the web or, put another way, to cause a sufficient amount of the entrained air to move away from the side that is impinged against the web, so that skdp coating does not result. It also is contemplated that the curved surface have a arcuate extent in the range of about 45° to 90°, with about 70° likely being optimum.

The angle of attack of the free standing jet curtain of coating liquid against the paper web, i.e., the included angle between the plane of the sheet or curtain of coating liquid and a tangent to the web surface at the point of contact of the sheet with the web, should be chosen to obtain optimum coating results. For the applicator 50, good coating results have been experimentally obtained with an included angle of 30° to 50°, and preferably about 35°, when using an outlet nozzle 74 having a width of 0.048", with the linear distance between the upper end of the deflector tip curved surface 78 and the point of impact of the coating liquid curtain against the web being on the order of 0.312", and with the deflector tip flat surface 76 having a length of about 0.125" in the direction of flow of the coating liquid sheet. However, these particular parameters may have other values, since the optimum value of each parameter is influenced by and generally dependent upon the values of the other parameters, and it is contemplated that the outlet nozzle have a width in the range of about 0.025" to 0.050" and also that the flat surface 76 on the deflector tip could be eliminated, in which case the curved surface 78 would begin immediately at the outlet nozzle 74.

By way of example, if the outlet nozzle 74 has a width of 0.048" and a length of 17", and if 5,000 cps viscosity coating liquid at 20 rpm Brookfield is flowed through the nozzle at a rate of 25 gallons per minute, then the cross-sectional area A of the nozzle is 0.816 square inch, the volume flow rate Q of coating through the nozzle is 5,775 cubic inches per minute, and the average velocity V of coating liquid through the nozzle is Q/A, i.e., 590 feet per minute. If it is assumed that there is a 35% reduction in effective nozzle gap due to the coating having zero velocity at the nozzle walls, then the fastest average velocity of coating liquid through the nozzle is 590/65, i.e., 908 feet per minute.

With an outlet nozzle width of 0.043", coating liquid flow rates from the nozzle can range from about 1.25 gallons per inch nozzle length in the direction transverse of the web to about 3.10 gallons per inch length, so for a nozzle having a length of 122", total flow rates of coating liquid through the outlet nozzle would be on the order of 170–380 gallons per minute. At such flow rates, the velocity of coating liquid flowing out of the nozzle would be in the range of about 560–1,375 feet per minute. Coating liquid is therefore emitted from the outlet nozzle and impinged against the web surface at relatively high velocities.

Figure 4:
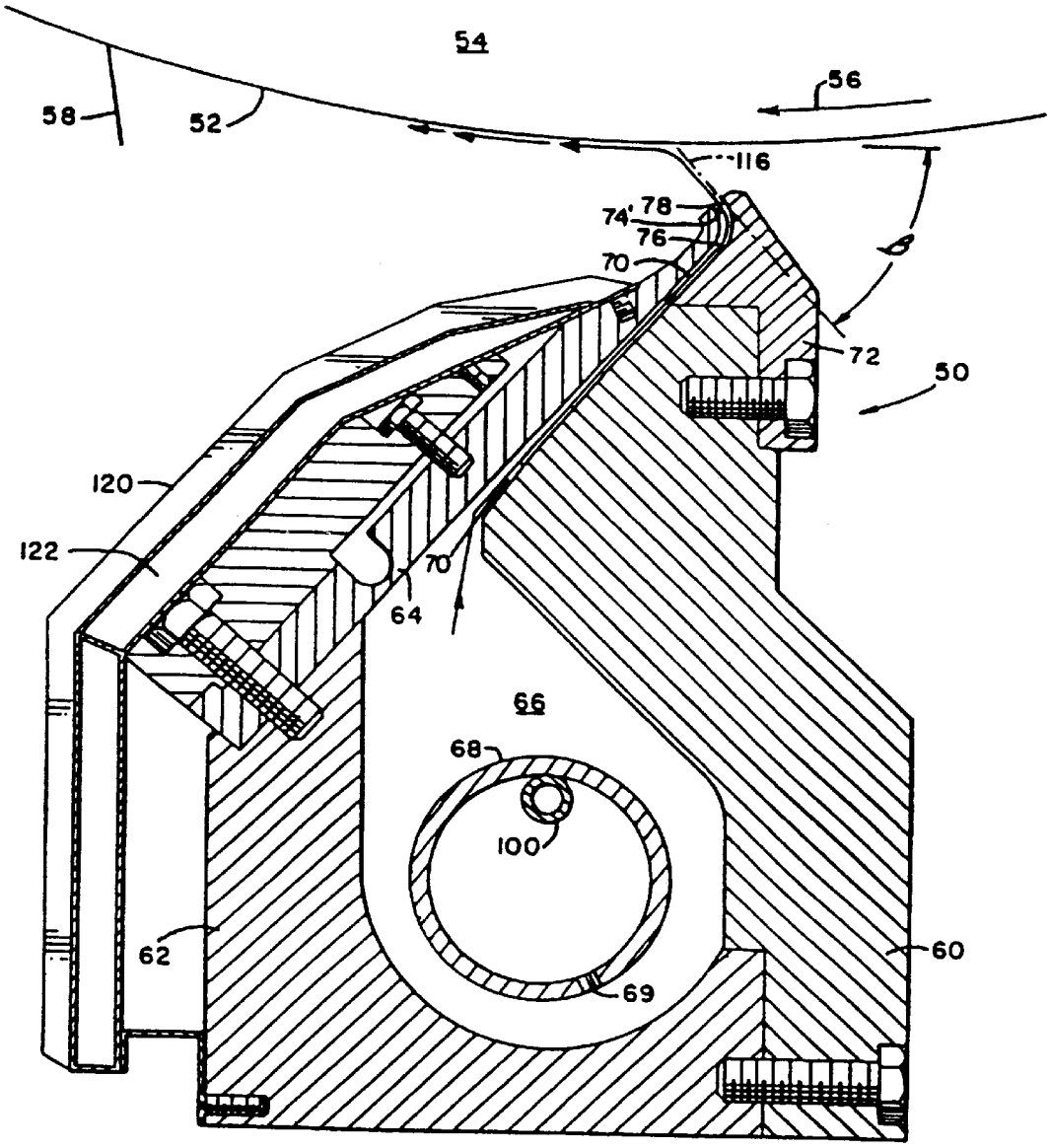
FIG. 4 shows an alternate embodiment of a fountain applicator that incorporates the teachings of the invention.

While in the fountain applicator 50 shown in FIG. 2, the coating liquid flow surfaces 76 and 78 of the deflector tip 72 are exposed to the outside of the applicator and located downstream from the metering slot 70 and the elongate outlet nozzle 74, the liquid flow surfaces could be part of and located within the fluid flow path defined by the metering slot 70. In this case, as shown in FIG. 4 the upper end of the plate 64 is extended along, spaced from and curved to conform to the fluid flow surfaces 76 and 78, so that the metering slot then extends along and includes the fluid flow surfaces. With this arrangement, the coating liquid sheet is subjected to centrifugal force while within the upper end of the metering slot, an elongate outlet nozzle 74' is at the uppermost end of the deflector tip, and the free standing sheet or jet curtain of coating liquid is projected directly from the elongate outlet nozzle.

In the embodiments of applicators shown in FIGS. 2 and 4, the path followed by the coating liquid sheet, preferably throughout the entirety of the metering slot 70, but at least as the sheet approaches the end of the metering slot and until it is projected from the applicator, advantageously curves in one direction only and, along any length where the path is not curved, it is straight. In consequence, the centrifugal force to which the coating liquid sheet is subjected is always in a direction to cause air entrained in the coating liquid sheet to move away from, not toward, the one side 116 of the sheet, i.e., the side of the sheet that is toward the outside of the curve(s) in the fluid flow path and with which the web surface is primarily contacted. In other words, the fluid flow path followed by the coating liquid never curves in a direction that would cause the coating liquid sheet to be subjected to centrifugal force that moves entrained air toward the one side 116 of the sheet. The one side of the coating liquid sheet, with which the web surface is primarily contacted, is therefore kept relatively free of entrained air. To obtain decreases in skip coating it is not necessary to move entrained air completely over to the opposite side of the coating liquid sheet, but only away from the one side of the sheet that primarily contacts the web, by perhaps several thousandths of an inch.

In addition, coating liquid is introduced under pressure into and onto the fluid flow path in order that the velocity flow of the coating liquid will be sufficiently fast to generate sufficient centrifugal force to properly practice the invention. This enables webs traveling at high speeds, from 2,400–6,000 feet per minute, to be properly coated with minimal, if any, occurrence of skip coating.

To collect run-off coating liquid that is not carried away on the paper web 52, as seen in FIG. 2, a run-off deflector 120 is on the outer surface of a chilled water jacket 122 carried on the plate 64. The run-off deflector leads to a return pan, from which coating liquid is returned to the surge tank 82, and the chilled water jacket facilitates cleaning of the run-off deflector.

Figure 5A:
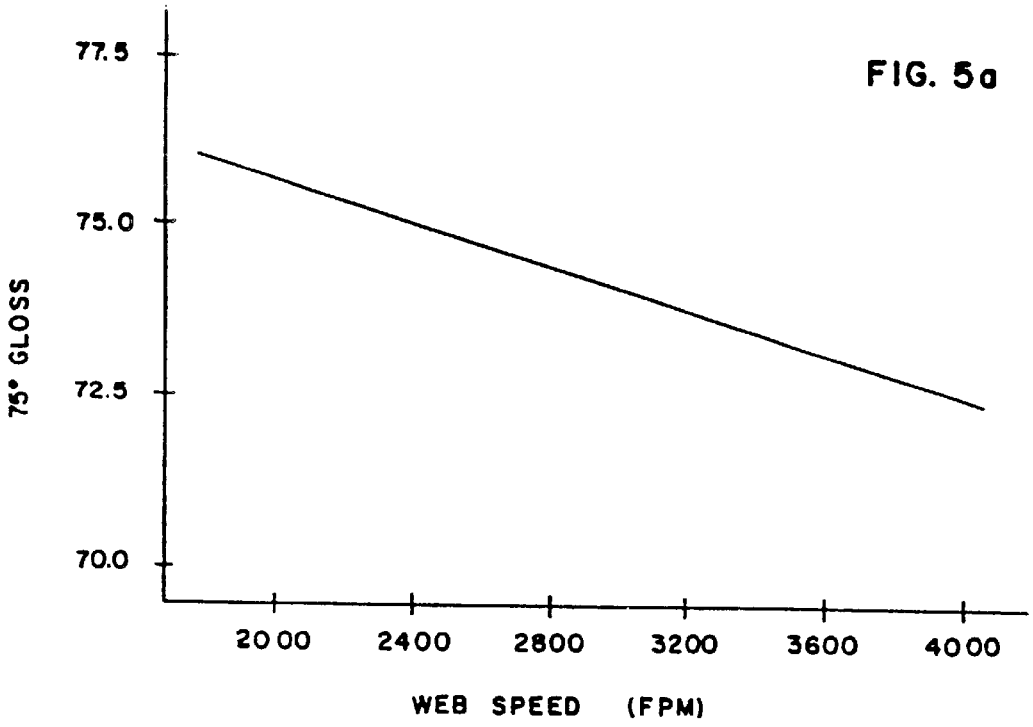
FIGS. 5A and 5B are graphs that respectively show the degrees gloss and the Parker Printsurf smoothness of a coating applied onto a web with the fountain applicator of FIG. 2, for various speeds of travel of the web past the applicator.
Figure 5B:
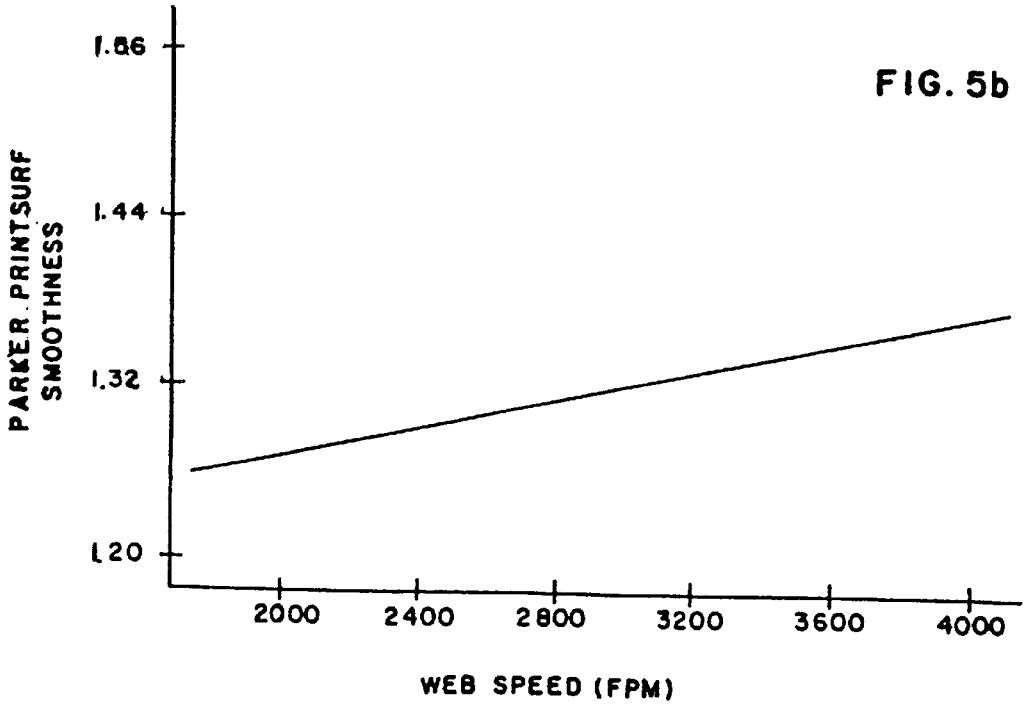

FIGS. 5A and 5B show coating results obtained experimentally when coatings were applied onto the same grade of paper with a fountain applicator constructed according to FIG. 2 and operated according to the teachings of the invention. FIG. 5A shows 75° gloss obtained at various web speeds and FIG. 5B shows Parker Printsurf smoothness measurements obtained at various web speeds.

Figure 6:
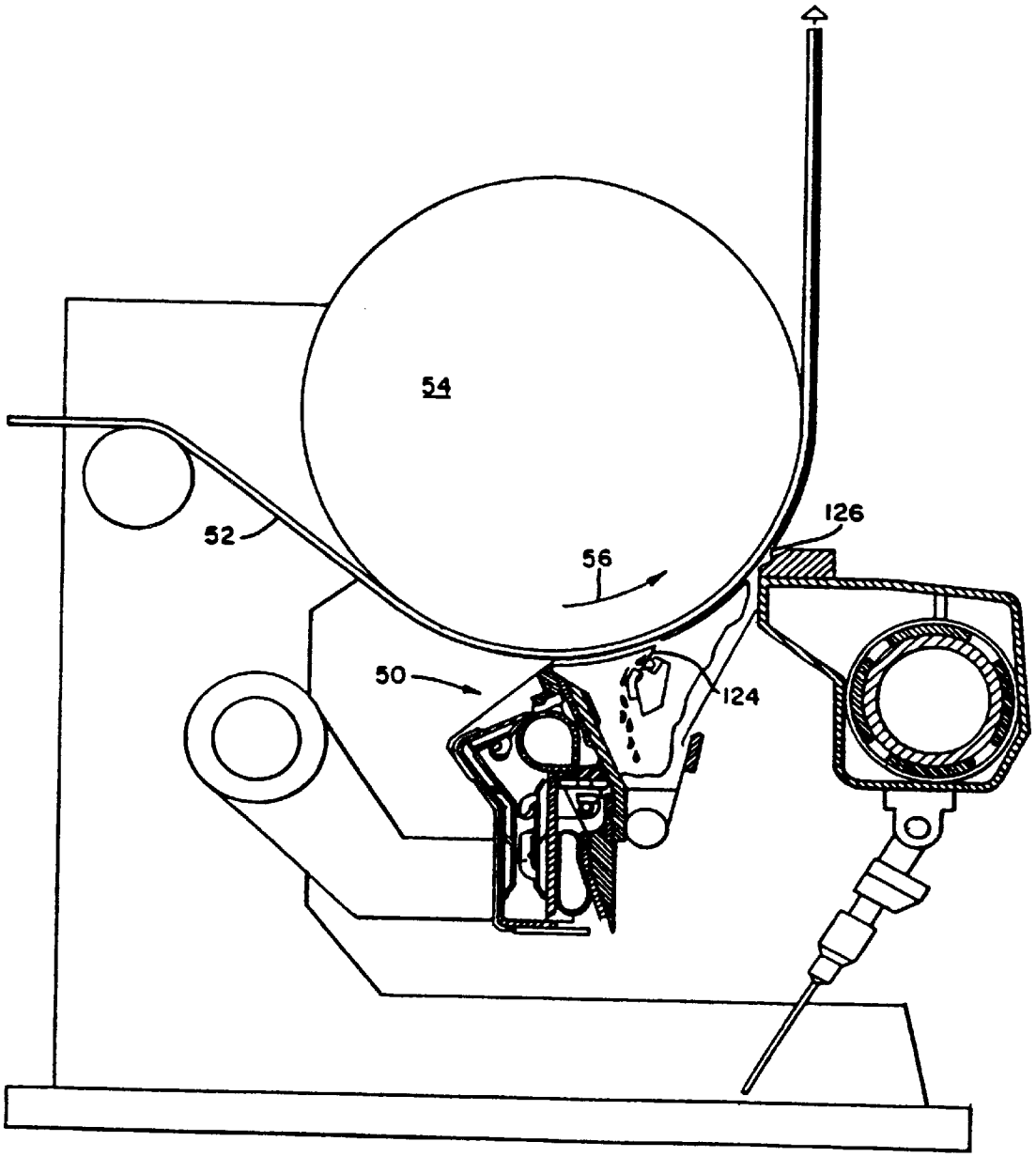
FIG. 6 shows a coating system embodying a fountain applicator of a type shown in either FIG. 2 or FIG. 4.

FIG. 6 shows a paper coating system that embodies a fountain applicator 50 of a type as in either FIG. 2 or FIG. 4. In general terms, the fountain applicator 50 applies a coating layer in excess onto the surface of the paper web 52 as the web is carried past the applicator on the backing roll 54. Downstream from the applicator, a first metering device or doctor, blade 124 doctors the coating on the web, leaving on the web surface a uniform and limited excess coating layer. Downstream from the first metering device, a second and final metering device or doctor blade 126 meters and levels the limited excess coating layer to a final coat weight.

More particularly, as the paper web 52 is carried by the backing roll 54 past the applicator 50, the applicator applies onto the web surface a coating layer in excess, which coating layer is relatively free of entrained air. Downstream from the applicator, the first metering device 124, which may comprise a doctor blade that is biased against the coated web at a relatively low doctoring pressure, leaves on the web a nonturbulent; generally uniform, relatively quiescent limited excess layer of coating having a wet film thickness greater, but not excessively greater, than the final desired wet film thickness. The second and final metering means 126, which may also comprise a doctor blade, is spaced a short distance downstream from the first doctor and acts on the generally uniform and quiescent limited excess layer of coating formed on the web by the first doctor. The second doctor is biased against the limited excess coating layer at a final doctoring pressure so as to doctor the limited excess of coating off of the web and to level the retained coating to an exceptionally smooth final layer of coating. The limited excess of coating delivered from the first doctor to the final doctor is such as to provide for continuous purging and optimum performance of the final doctor.

While embodiments of the invention have been described in detail, various modifications and other embodiments thereof may be devised by one skilled in the art without departing from the spirit and scope of the invention, as defined in the appended claims.

What is claimed is:

1. Apparatus for applying a coating liquid onto a surface of a moving web, comprising:

a coating liquid applicator having an elongate variable width outlet nozzle having a width selected to control the width or thickness and flow velocity of coating liquid emitted therefrom and an elongate coating liquid deflector that is positioned proximate to, spaced from and transversely of the web and that has an elongate concave curved surface:

means for pressure delivery of a sheet of coating liquid in which air is entrained both through said elongate variable width outlet nozzle and to said elongate deflector for flow along said curved surface in an elongate sheet of coating liquid that, after flowing along said curved surface, is projected in a free standing sheet of coating liquid toward, across, against and onto the surface of the web to provide an excess layer of coating liquid on the web surface, the coating liquid sheet, while flowing along said deflector curved surface, being at a velocity that is sufficient, when taken together with the radius of curvature of said curved surface, to subject the coating liquid sheet to centrifugal force of a magnitude that causes air entrained in the coating liquid to move away from one side of the coating liquid sheet that is toward said curved surface and toward the opposite side of the coating liquid sheet, so that the one side of the coating liquid sheet is relatively free of entrained air, and said deflector being oriented relative to the web so that an acute included angle exists between the one side of the coating liquid sheet and a tangent to the web at the point of contact of the sheet with the web, thereby to decrease the occurrence of skip coating on the web surface; and means for doctoring the excess layer of coating liquid on the web surface.

2. Apparatus as in claim 1, wherein said doctor means comprises a first doctor means downstream from said applicator, in the direction of web travel, for doctoring the excess coating liquid layer on the web surface and for leaving on the web surface a nonturbulent, generally uniform and relatively quiescent limited excess layer of coating having a wet film thickness greater than a desired final wet film thickness, and a second doctor means downstream from said first doctor means for doctoring the generally uniform and quiescent limited excess layer of coating formed on the web by said first doctor means so as to doctor the limited excess coating off of the web surface and to level the retained coating to a smooth final layer of coating.

3. Apparatus as in claim 1, wherein said means for pressure delivery of a sheet of coating liquid comprises a coating liquid supply that includes an air removal device for removing from the coating liquid a substantial amount of air that is entrained in the coating liquid, prior to pressure delivery of the sheet of coating liquid to said elongate deflector.

4. Apparatus as in claim 1, wherein said deflector curved surface has an arcuate extent in the range of about 45° to 90°.

5. Apparatus as in claim 1, wherein said deflector curved surface has a radius in the range of about 0.125 to 0.500".

6. Apparatus as in claim 1, wherein said variable width elongate outlet nozzle has a width that is variable to be in the range of about 0.025" to 0.050".

7. Apparatus as in claim 1, wherein the sheet of coating liquid lies in a plane and the included angle between the plane of the free standing coating liquid sheet and a tangent to the surface of the web at the point of contact of the liquid sheet with the web is in the range of about 30° to 50°.

8. Apparatus for applying a coating liquid onto a surface of a moving web, comprising:

a coating liquid flow path that is laterally elongate and that includes an elongate variable width outlet nozzle having a width selected to control the width or thickness and the flow velocity of coating liquid emitted therefrom and a laterally elongate concave curved surface, a downstream end of said flow path being positioned proximate to, spaced from and transversely of the web;

means for flowing a sheet of coating liquid in which air is entrained along said flow path and beyond said downstream end of said flow path in a free standing laterally elongate sheet of coating liquid that is directed toward, across and against the surface of the web to provide an excess layer of coating liquid on the web surface, the coating liquid, while flowing along said flow path curved surface, being a velocity that is sufficient, when taken together with the radius of curvature of said curved surface, to subject the coating liquid sheet to centrifugal force of a magnitude that causes air entrained in the coating liquid to move away from one side of the coating liquid sheet that is toward said curved surface, so that the one side of the coating liquid sheet is relatively free of entrained air, the free standing sheet of coating liquid being directed against the web so that an acute included angle exists between the one side of the coating liquid sheet and a tangent to the web at the point of contact of the sheet with the web, thereby to decrease the occurrence of skip coating on the web surface; and means for doctoring the excess layer of coating liquid on the web surface.

9. Apparatus as in claim 8, wherein said doctor means comprises a first doctor means downstream from said applicator, in the direction of web travel, for doctoring the excess coating liquid layer on the web surface and for leaving on the web surface a nonturbulent, generally uniform and relatively quiescent limited excess layer of coating having a wet film thickness greater than a desired final wet film thickness, and a second doctor means downstream from said first doctor means for doctoring the generally uniform and quiescent limited excess layer of coating formed on the web by said first doctor means, so as to doctor the limited excess coating off of the web surface and to level the retained coating to a smooth final layer of coating.

10. Apparatus as in claim 8, wherein said means for flowing a sheet of coating liquid comprises a coating liquid supply that includes an air removal device for removing from the coating liquid a substantial amount of air that is entrained in the coating liquid prior to flowing the sheet of coating liquid along said flow path.

11. Apparatus as in claim 8, wherein said curved surface has an arcuate extent in the range of about 45° to 90°.

12. Apparatus as in claim 8, wherein said curved surface has a radius in the range of about 0.125 inch to 0.500 inch.

13. Apparatus as in claim 8, wherein the acute included angle between the one side of the free standing coating liquid sheet and a tangent to the surface of the web at the point of contact of the free standing coating liquid sheet with the web is in the range of about 30° to 50°.

14. Apparatus as in claim 8, wherein said concave curved surface is proximate to said downstream end of said flow path.

15. Apparatus as in claim 8, wherein a downstream end of said concave curved surface is at said flow path downstream end.

16. Apparatus as in claim 8, including means for pressure delivery of coating liquid to said variable width elongate outlet nozzle for flow through said outlet nozzle and along said flow path concave curved surface in an elongate sheet of coating liquid.

17. Apparatus as in claim 12, wherein said elongate outlet nozzle has a width that is variable to be in the range of about 0.025" to 0.050".

18. Apparatus as in claim 1, wherein said means for pressure delivery first delivers the sheet of coating liquid to said variable width elongate outlet nozzle and then to said elongate coating liquid deflector.

19. Apparatus as in claim 1, wherein said means for pressure delivery first delivers the sheet of coating liquid to said elongate coating liquid deflector and then to said variable width elongate outlet nozzle.

20. Apparatus as in claim 8, wherein said variable width elongate outlet nozzle is upstream from said elongate curved surface in the direction of coating liquid flow along said flow path.

21. Apparatus as in claim 8, wherein said variable width elongate outlet nozzle is downstream from said elongate curved surface in the direction of coating liquid flow along said flow path.

* * * * *